US009389046B2

(12) United States Patent
Cheng et al.

(10) Patent No.: US 9,389,046 B2
(45) Date of Patent: Jul. 12, 2016

(54) SIGHT MODULE FOR FIREARM

(71) Applicants: Carson Cheng, City of Industry, CA (US); Jason Michael Cheng, City of Industry, CA (US)

(72) Inventors: Carson Cheng, City of Industry, CA (US); Jason Michael Cheng, City of Industry, CA (US)

(73) Assignee: NvSTAR, Inc., City of Industry, CA (US)

( * ) Notice: Subject to any disclaimer, the term of this patent is extended or adjusted under 35 U.S.C. 154(b) by 38 days.

(21) Appl. No.: 14/252,766

(22) Filed: Apr. 14, 2014

(65) Prior Publication Data

US 2015/0292837 A1 Oct. 15, 2015

(51) Int. Cl.
*F41G 1/38* (2006.01)
*F41G 1/34* (2006.01)

(52) U.S. Cl.
CPC .. *F41G 1/38* (2013.01); *F41G 1/345* (2013.01)

(58) Field of Classification Search
CPC ..... F41G 1/38; F41G 1/42; F41G 1/345
USPC ..... 42/115, 117, 119, 120, 122–128, 42/130–133, 135, 138, 141, 106, 111
See application file for complete search history.

(56) References Cited

U.S. PATENT DOCUMENTS 4,859,058 A * 8/1989 Ekstrand ..... G02B 23/14 356/251
8,186,093 B1 * 5/2012 Chung ..... F41G 1/30 42/113
8,656,629 B2 * 2/2014 Holmberg ..... F41G 11/003 33/265
8,931,161 B2 * 1/2015 Couture ..... F41G 11/003 29/464
2009/0307954 A1 * 12/2009 Wang ..... F41G 11/003 42/90
2010/0071247 A1 * 3/2010 Holmberg ..... F41C 27/00 42/124
2010/0077646 A1 * 4/2010 Gaber ..... F41G 1/467 42/123
2012/0311909 A1 * 12/2012 Cheng ..... F41G 11/003 42/90
2014/0123532 A1 * 5/2014 Russ ..... F41G 1/38 42/113
2014/0259853 A1 * 9/2014 Crispin ..... F41G 1/38 42/124

* cited by examiner

*Primary Examiner* — Samir Abdosh
*Assistant Examiner* — John D Cooper
(74) *Attorney, Agent, or Firm* — Raymond Y. Chan; David and Raymond Patent Firm

(57) ABSTRACT

A sight module for a firearm having a barrel axis includes a base for detachably attaching onto the firearm, a first optic upwardly extended from the base to define a first sight axis parallel to the barrel axis of the firearm, and a second optic sidewardly extended from the first optic to define a second sight axis parallel to the barrel axis of the firearm and oriented at an offset angle with respect to the first sight axis, wherein a distance between the first sight axis and the barrel axis equals to a distance between the second sight axis and the barrel axis. Therefore, a user is able to maintain the same cheek weld on the firearm stock to view one of the first and second optics in order to quickly switch between the first and second optics by simply rotating the firearm.

11 Claims, 7 Drawing Sheets

SIGHT MODULE FOR FIREARM

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an accessory of a firearm, and more particular to a sight module, which is integrated with magnified optical sight and reflex sight to form an all-in-one sight device.

2. Description of Related Arts

Scope device, such as a scope, telescope, camera lens module, or binoculars, generally comprises a tubular lens housing and a lens supported in the lens housing. For example, scopes are sighting device and are commonly used in conjunction firearms, such as rifles, to give an accurate aiming point and to aid a user in properly aligning a barrel of the firearm with a desired target. The scope generally comprises a tubular lens housing and two lenses provided at two ends of the lens housing to define an objective end and a sight (ocular) end. Since different scope devices provide different functions and these functions are not interchangeable, the user will normally mount two or more different scope devices at the firearm.

Accordingly, magnified or powered scopes are used for mid to long range sniping to aim and identify targets at further distances. The magnified scope generally comprises windage and elevation knobs to change an apparent reticle position of the scope. In particular, the windage knob is used to adjust the scope in the horizontal axis and the elevation knob is used to adjust the scope in the vertical axis. The calibration of the apparent reticle position is incorporate with the bore of the barrel of the firearm according to the hand-eye position of the user in order to allow the user to precisely aim and shoot the target.

Reflex sight device is another type of scope device which is better suited for quick target acquisition and is easier for tracking moving targets at closer ranges comparing with the magnified scope. Reflex sight generally comprises a lens with a luminous to create an optical collimator so as to produce a virtual image of the reticle. A control switch is provided for controlling the reticle illumination level and dot brightness level of the reflex sight.

The magnified scope and reflex sight are perfect companion for the user to aim and identify targets at different distances. The user can switch between these two scope devices especially for a moving target. However, when switching between these scope devices, the user must move the firearm to view the ocular end of the scope device from the other. In other words, the movement of the firearm will slow down the engagement of the target and will even lose the target especially the target rapidly moves at different distances. Furthermore, it is impossible for the user to adjust both of the magnified scope and reflex sight by one hand since the magnified scope and reflex sight are mounted at different locations of the firearm. In other words, the user has to move his or her fingers from the control switch of one of the scope devices to the other for individual adjustment. Since each scope device employs its own power source for reticle illumination. As a result, the overall weight of the scope devices will be substantially increased to apply additional weight on the firearm. The two individual scope devices will also take up limited mounting space of the firearm, such that other firearm accessories, such as laser sight, navigation lights, flashlight, or a camera, will not be able to attach to the firearm.

SUMMARY OF THE PRESENT INVENTION

The invention is advantageous in that it provides a sight module, which is integrated with magnified optical sight and reflex sight to form an all-in-one sight device Another advantage of the invention is to provide a sight module, wherein both magnified optical sight and reflex sight maintain the reticle at the same height above the bore of the barrel of the firearm so as to allow the user to precisely and rapidly engage the target.

Another advantage of the invention is to provide a sight module, wherein the user is able to quickly switch between the magnified optical sight and reflex sight by simply rotating the firearm for accessing without re-adjusting the position of the firearm with respect to the user's body.

Another advantage of the invention is to provide a sight module, wherein the user can maintain the same cheek weld on the firearm stock to view one of the magnified optical sight and reflex sight to prevent any unnecessary movement of the firearm.

Another advantage of the invention is to provide a sight module, wherein a universal control panel is provided for independently controlling the reticle illumination level in the magnified optical sight and dot brightness level in the reflex sight, such that the user is able to control both of the magnified optical sight and reflex sight by one hand.

Another advantage of the invention is to provide a sight module, wherein one single power source is utilized for both of the magnified optical sight and reflex sight to substantially reduce the overall weight of the sight module.

Another advantage of the invention is to provide a sight module, which requires one single mounting space of the firearm to enable other different accessories to be attached to the firearm.

Another advantage of the invention is to provide a sight module, which does not require to alter the original structural design of the mounting structure of the firearm, so as to minimize the manufacturing cost of the mounting structure of the firearm incorporating with the sight module.

Another advantage of the invention is to provide a sight module, wherein no expensive or complicated structure is required to employ in the present invention in order to achieve the above mentioned objects. Therefore, the present invention successfully provides an economic and efficient solution for providing a dual sight configuration for the firearm with compact and ergonomic design.

Additional advantages and features of the invention will become apparent from the description which follows, and may be realized by means of the instrumentalities and combinations particular point out in the appended claims.

According to the present invention, the foregoing and other objects and advantages are attained by a sight module for a firearm having a barrel axis, which includes a base for detachably attaching onto the firearm, a first optic and a second optic.

The first optic is upwardly extended from the base to define a first sight axis parallel to the barrel axis of the firearm.

The second optic is sidewardly extended from the first optic to define a second sight axis parallel to the barrel axis of the firearm and orientated at an offset angle with respect to the first sight axis, wherein a distance between the first sight axis and the barrel axis equals to a distance between the second sight axis and the barrel axis. Therefore, a user is able to maintain the same cheek weld on the firearm stock to view one of the first and second optics in order to quickly switch between the first and second optics by simply rotating the firearm.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
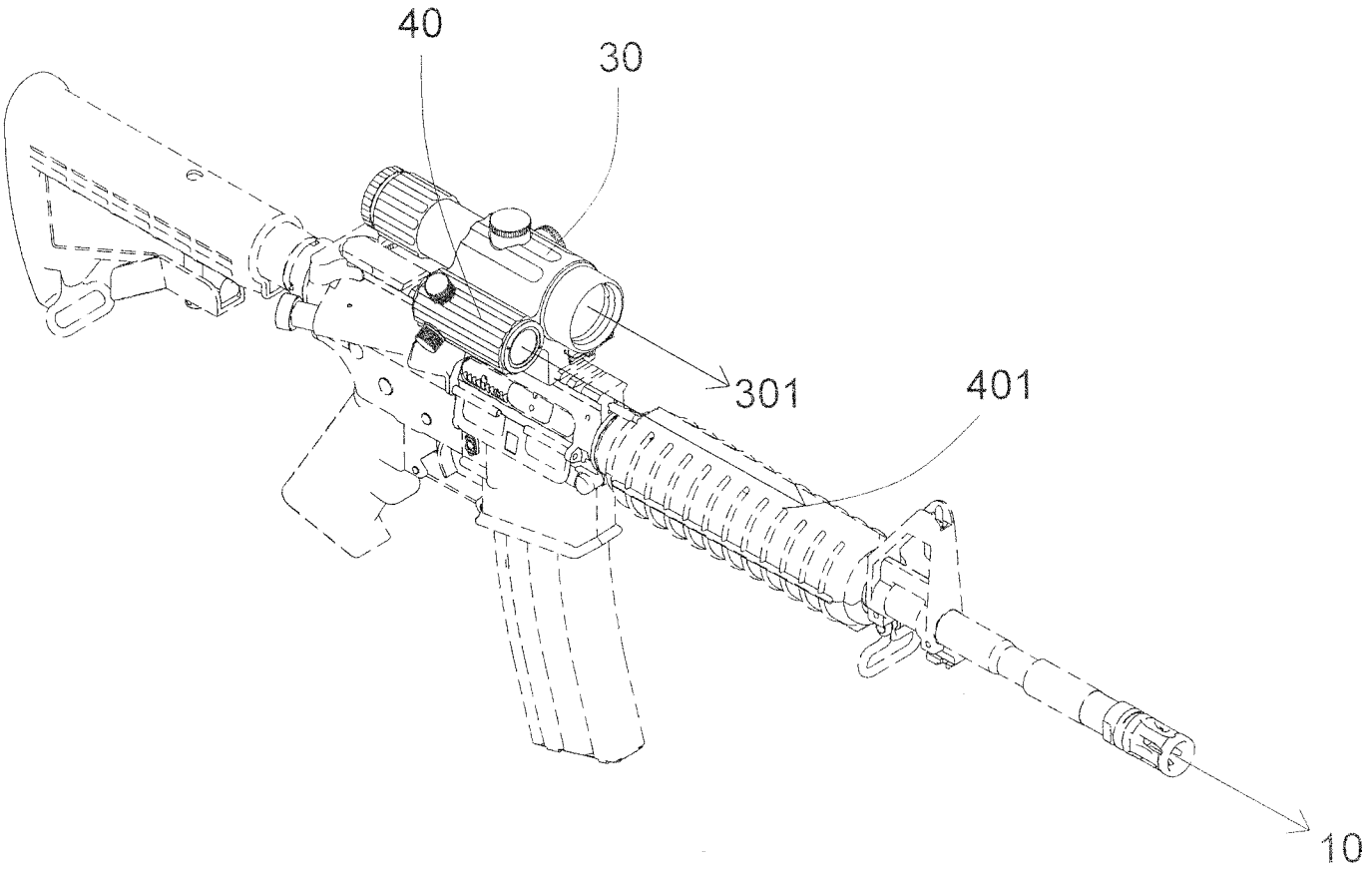
FIG. 1 is a perspective view of a sight module mounted on a firearm according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 4 of the drawings, a sight module for a firearm according to a preferred embodiment of the present invention. Accordingly, the firearm, such as a rifle, comprises a barrel defining a barrel axis 10, and a stock, such that when the user places the firearm at the shoulder, the user can lean the head over onto the stock to cheek weld on the stock. According to the preferred embodiment, the sight module comprises a base 20, a first optic 30, and a second optic 40.

The base 20 comprises a mounting arrangement 21 provided at a bottom side of the base for detachably attaching onto the firearm. Accordingly, the mounting arrangement 21 can be a "Weaver" mounting structure, a "Picatinny" mounting structure, or "KeyMod" mounting structure provided at the bottom side of the base 20 to detachably couple at the firearm.

Figure 2:
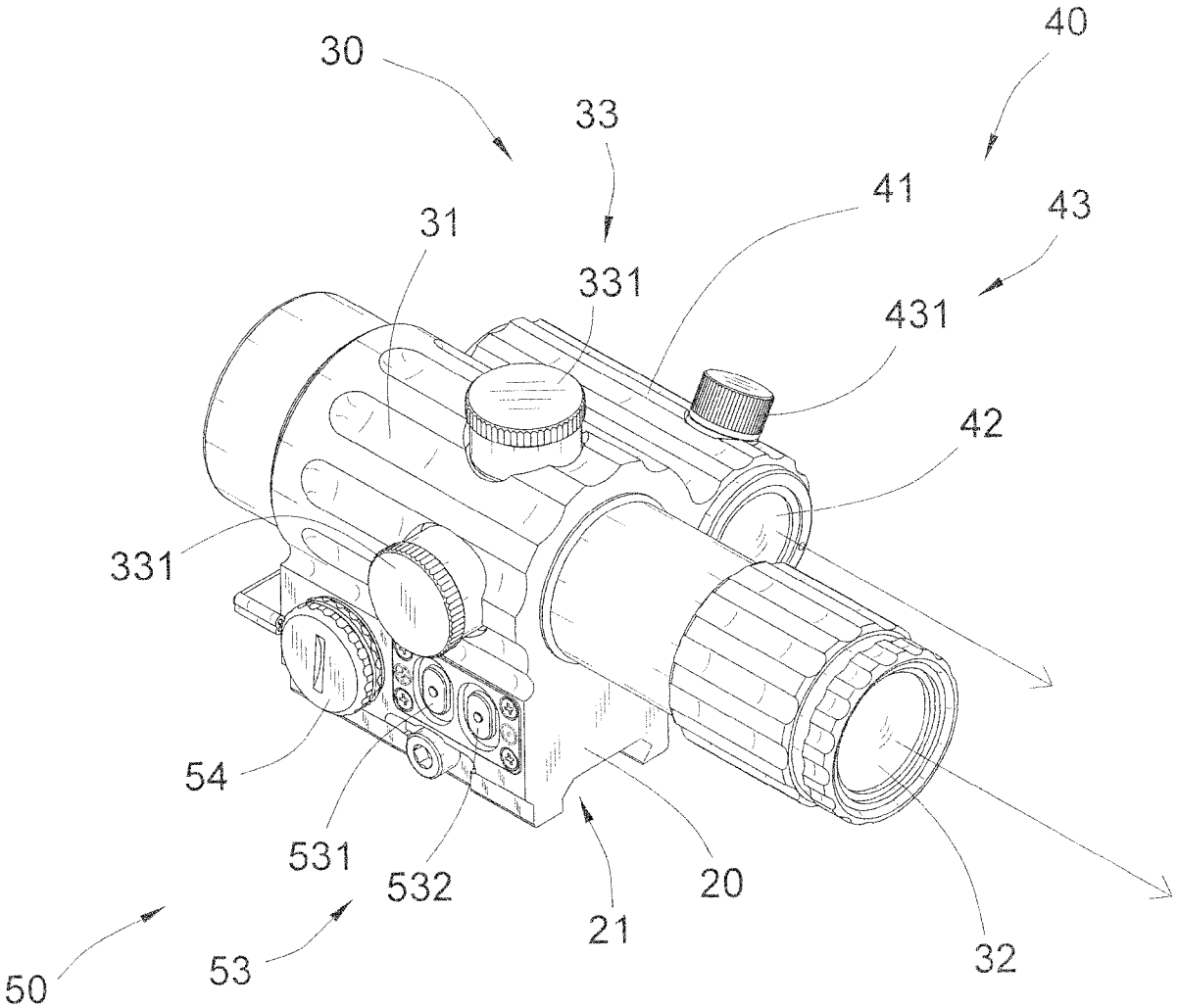
FIG. 2 is a perspective view of the sight module according to the above preferred embodiment of the present invention.
Figure 3:
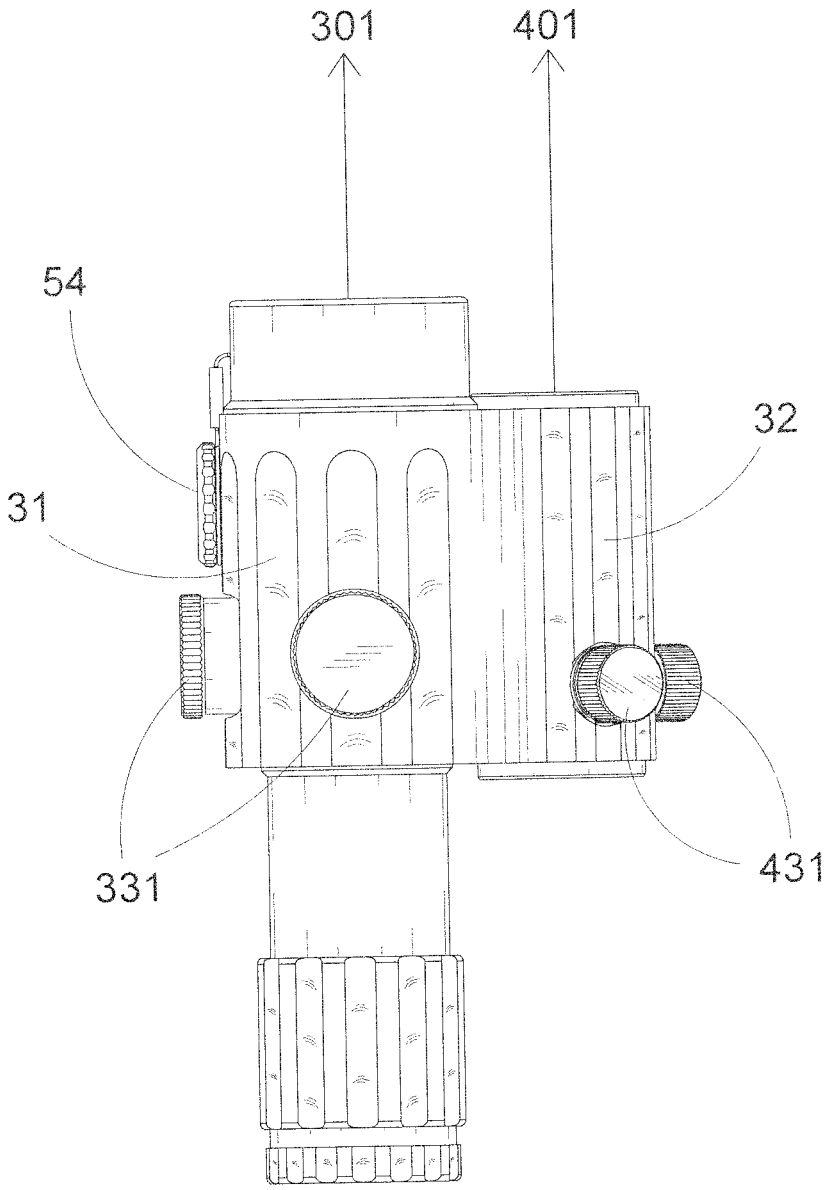
FIG. 3 is a top view of the sight module for the firearm according to the above preferred embodiment of the present invention.
Figure 5:
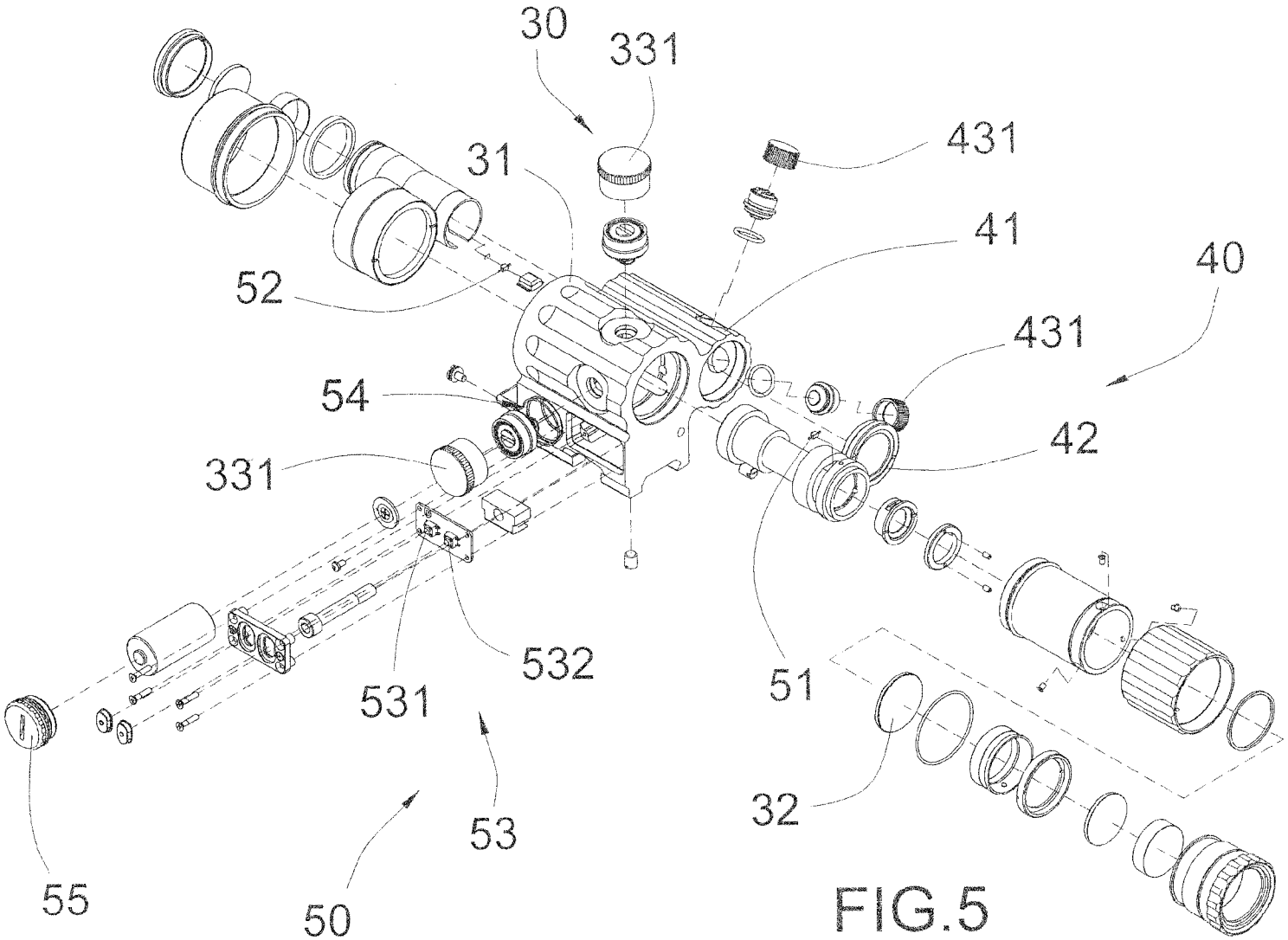
FIG. 5 is an exploded perspective view of the sight module for the firearm according to the above preferred embodiment of the present invention.

The first optic 30, according to the preferred embodiment, is a magnified scope, wherein the first optic 30 is upwardly extended from the base 20 to define a first sight axis 301 parallel to the barrel axis 10 of the firearm. As shown in FIGS. 2 and 5, the first optic 30 comprises a tubular first lens housing 31 upwardly extended from the base 20 in an upright position with respect to the firearm, and a first lens assembly 32 provided in the first lens housing that provides magnification zoom for aiming and identifying target at further distances. The first optic 30 further comprises a first reticle adjustment 33 formed at a surrounding wall of the first lens housing 31 for selectively adjusting a reticle position of the first optic 30.

The first lens housing 31 is extended from the firearm in the upright position such that the first lens housing 31 is upwardly aligned with the stock of the firearm. The first lens housing 31 has a first front opening serving as an objective end and a first rear opening serving as an ocular end, wherein the first front and rear openings of the first lens housing 31 are coaxially aligned with each other. The first sight axis 301 is defined at a centerline between the first front and rear openings of the first lens housing 31.

The first lens assembly 32 comprises a plurality of first lens groups, such as an objective lens group, erector lens group, and an ocular lens group, providing magnification zoom for aiming and identifying target at further distances.

The first reticle adjustment 33 comprises a plurality of first turn knobs 331, i.e. windage and elevation knobs, to adjust the reticle position in the horizontal axis and in the vertical axis. One of the first turn knobs 331 is operatively provided at the surrounding wall of the first lens housing 31 in a vertical direction while another first turn knob 331 is operatively provided at the surrounding wall of the first lens housing 31 in a horizontal direction.

The second optic 40, according to the preferred embodiment, is a non-magnified reflex dot optic, wherein the second optic 40 is sidewardly extended from the first optic 30 to define a second sight axis 401 parallel to the barrel axis 10 of the firearm and orientated at an offset angle □ with respect to the first sight axis 301. Accordingly, a distance D1 between the first sight axis 301 and the barrel axis 10 equals to a distance D2 between the second sight axis 401 and the barrel axis 10.

According to the preferred embodiment, the first and second optics 30, 40 are arranged for aiming and identifying target at different distances. The first optic 30 has an aiming distance farther than an aiming distance of the second optic 40. Preferably, the offset angle is about 30°.

The second optic 40 comprises a tubular second lens housing 41 sidewardly and downwardly extended from the first lens housing 31 at the offset angle □ with respect to the firearm, and a second lens assembly 42 provided in the second lens housing 41 for use in close-target situations. The second optic 40 further comprises a second reticle adjustment 43 formed at a surrounding wall of the second lens housing 41 for selectively adjusting a reticle position of the second optic 40.

Figure 4:
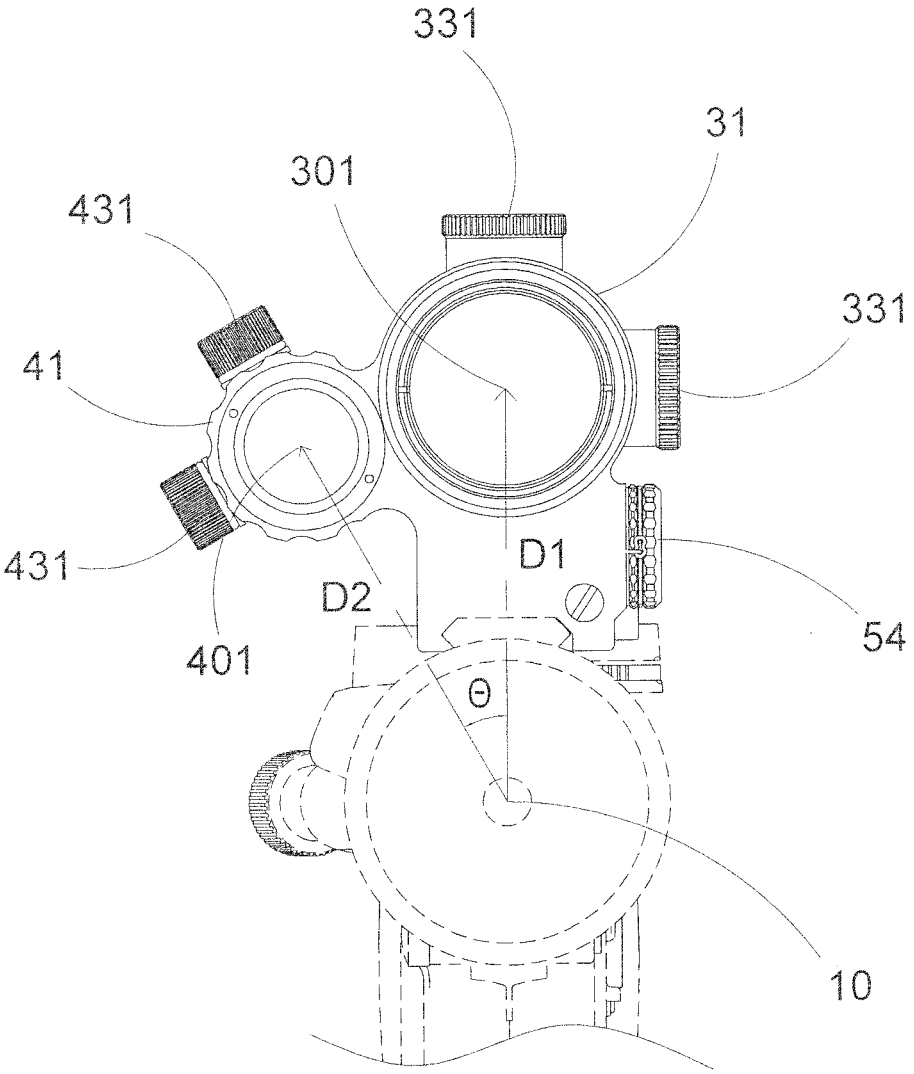
FIG. 4 is a rear view of the sight module for the firearm according to the above preferred embodiment of the present invention.

The second lens housing 41 is orientated with respect to the firearm at the offset angle □, such that the second lens housing 41 is inclinedly aligned with the stock of the firearm. The second lens housing 41 has a second front opening serving as an objective end and a second rear opening serving as an ocular end, wherein the second front and rear openings of the second lens housing 41 are coaxially aligned with each other. The second sight axis 401 is defined at a centerline between the second front and rear openings of the second lens housing 41. Preferably, the second lens housing 41 is integrally extended from the first lens housing 31 to form an integrated housing body, as shown in FIGS. 2 and 4.

The second lens assembly 42 comprises a lens module that reflects a reticle image, such as red dots, onto a combining glass for superimposition on a target without distorting the image of the target.

The second reticle adjustment 43 comprises a plurality of second turn knobs 431, i.e. windage and elevation knobs, to adjust the reticle position (red dot) in the horizontal axis and in the vertical axis. One of the second turn knobs 431 is operatively provided at the surrounding wall of the second lens housing 41 at the offset angle □ while another second turn knob 431 is operatively provided at the surrounding wall of the second lens housing 41, wherein the second turn knobs 431 are perpendicular to each other.

According to the preferred embodiment, the sight module further comprises an illumination control 50 operatively linked to the first and second optics 30, 40. The illumination control 50 comprises a first luminous element 51 operatively provided in the first optic 30 for illumining a first reticle thereof, a second luminous element 52 operatively provided in the second optic 40 for illumining a second reticle thereof, and a control panel 53 provided at the base 20 for independently controlling reticle illumination level and brightness level of each of the first and second luminous elements 51, 52.

Accordingly, the first and second luminous elements 51, 52 are preferably two LEDs supported within the first and second lens housings 31, 41 respectively for illumining the first and second reticles of the first and second optics 30, 40.

The control panel 53 is formed at a sidewall of the base 20 to operatively link to the first and second luminous elements 51, 52. Preferably, the control panel 53 is located below the horizontal first turn knob 311 at the surrounding wall of the first lens housing 31. The control panel 53 has two individual control switches 531, 532 for individually controlling the first and second luminous elements 51, 52 respectively. It is worth mentioning that the two control switches 531, 532 of the control panels 53 are positioned close to each other and are located at the same side of the base 20, such that the user is able to control the first and second luminous elements 51, 52 by one hand that supports the firearm.

The illumination control further comprises a power source compartment 54 provided at the base for receiving a power source, such as a battery, therein in order to electrically link with the first and second luminous elements 51, 52. The power source compartment 54 is formed at the sidewall of the base 20 at a position in front of the control panel 53, wherein a compartment cap 55 is detachably coupled at the sidewall of the base 20 to enclose the power source compartment 54. Therefore, the first and second luminous elements 51, 52 will share the same power source to minimize the overall weight of the sight module. In other words, the user is able to control the first and second optics 30, 40 by one hand.

Figure 6:
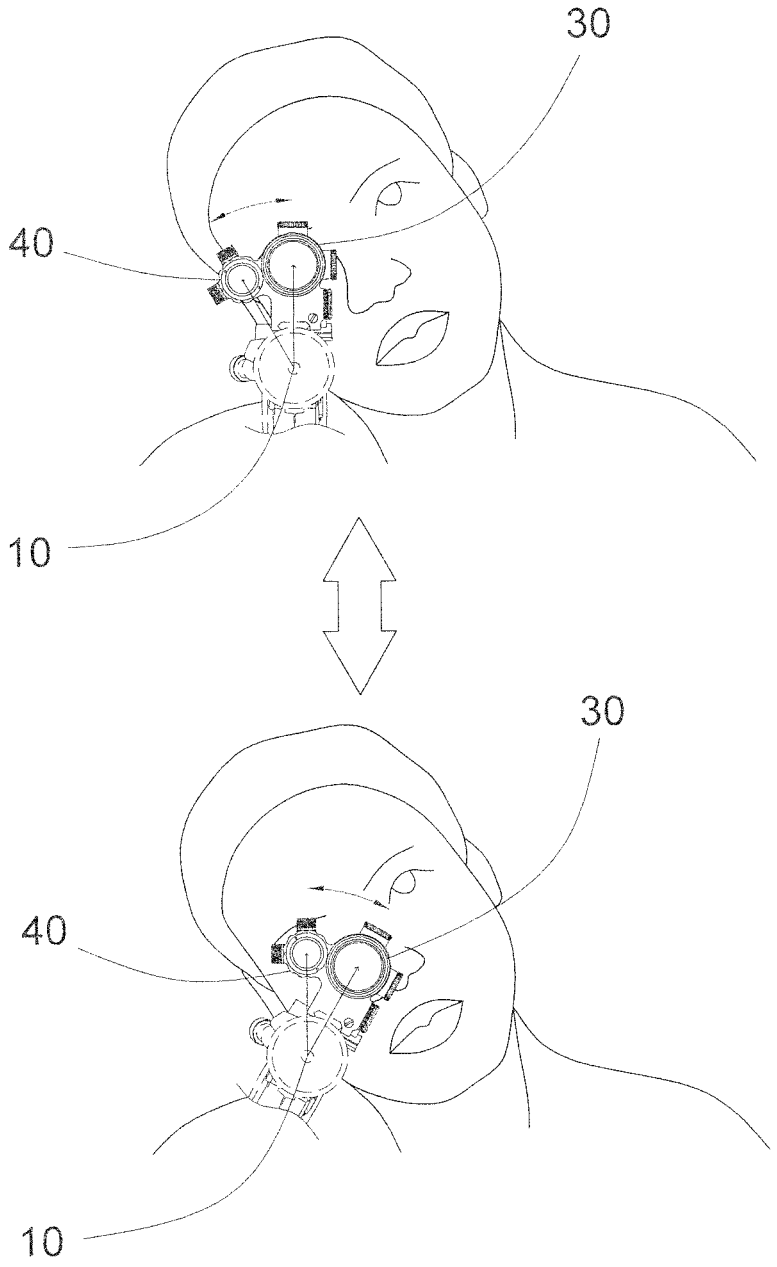
FIG. 6 illustrates the quick switch between the first and second optics of the sight module via the rotation of the firearm according to the above preferred embodiment of the present invention.

According to the preferred embodiment, the user is able to quickly switch between the first and second optics 30, 40 without moving the firearm in horizontal or vertical direction. Since the distance Dl of the first sight axis 301 equals to the distance D2 of the second sight axis 401 with respect to the barrel axis 10, the user can quickly switch between the first and second optics 30, 40, as shown in FIG. 6, by simply rotating the firearm for accessing without re-adjusting the position of the firearm with respect to the user's body. In particular, the user can maintain the same cheek weld on the firearm stock to view one of the first and second optics 30, 40. For example, if the second optic 40 is upwardly and vertically extended from the first optic 30, the user must drop the firearm for switching to the second optic 40 from the first optic 30, and lift up the firearm for switching from the second optic 40 back to the first optic 30. Likewise, if the second optic 40 is horizontally extended from the first optic 30, the user must sidewardly shift the firearm for switching to the second optic 40 from the first optic 30, and sidewardly shift the firearm for switching from the second optic 40 back to the first optic 30. These configurations will not allow the user to maintain the same cheek weld on the firearm stock when switching between the first and second optics 30, 40. Only when the second optic 40 is extended from the first optic 30 with respect to the offset angle □ of the firearm, the user is able to rotate the firearm and to maintain the same cheek weld on the firearm stock when switching between the first and second optics 30, 40. It is worth mentioning that the user is able to hold the firearm by two hands and to rotate the firearm by the wrist movements of the hands. In addition, when switching between the first and second optics 30, 40, the user is also able to control the first and second luminous elements 51, 52 by one hand via the control switches 531, 532 of the control panels 53.

Figure 7:
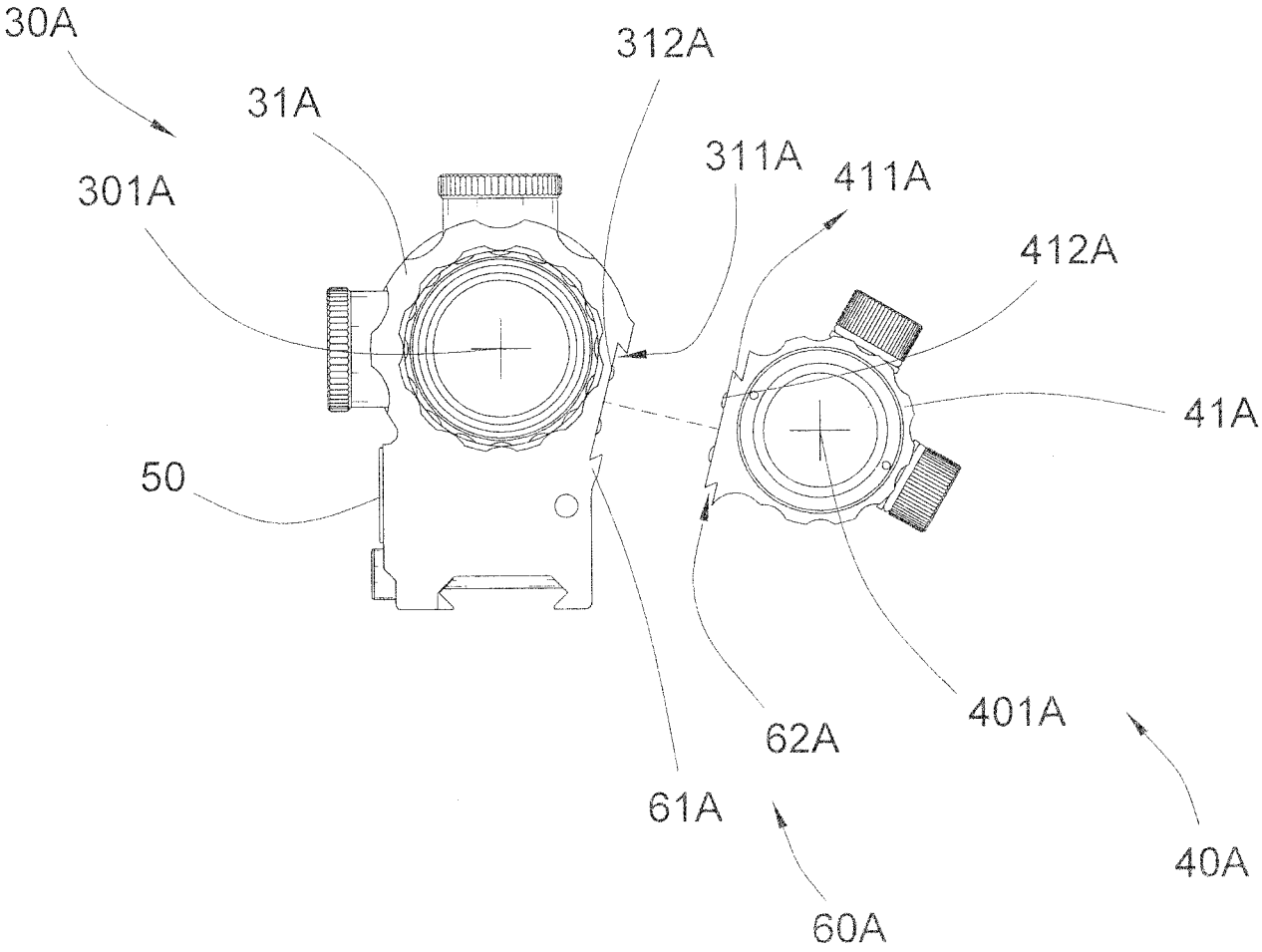
FIG. 7 illustrates an alternative mode of the of the sight module for the firearm according to the above preferred embodiment of the present invention.

FIG. 7 illustrates an alternative mode of the sight module which has the same configuration as mentioned above, expect the detachably feature of the second optic 40A. As shown in FIG. 7, the second optic 40A is detachably coupled to the first optic 30A, wherein when the second optic 40A is attached to the first optic 30A, the second optic 40A is sidewardly extended from the first optic 30A to retain the second sight axis 401A at the offset angle with respect to the first sight axis 301A.

In particular, the second lens housing 41A is detachably coupled to the first lens housing 31A. The first lens housing 31A has a first attachment surface 311A and the second lens housing 41A has a second attachment surface 411A, wherein the first and second attachment surfaces 311A, 411A are detachably coupled with each other via an attachment unit 60A. Preferably, the attachment unit 60A comprises a guiding track 61A formed at the first attachment surface 311A and a sliding slot 62A formed at the second attachment surface 411A, wherein the guiding track 61A is slidably engaged with the sliding slot 62A to detachably couple the second lens housing 41A to the first lens housing 31A. Preferably, first and second terminals 312A, 412A are provided at the first and second attachment surfaces 311A, 411A respectively, such that when the second lens housing 41A is coupled to the first lens housing 31A, the first and second terminals 312A, 412A are contacted with each other, so as to enable the illumination control 50 operatively linked to the first and second optics 30A, 40A to control the illumination operations thereof.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sight module for a firearm having a barrel axis, comprising:

a base for detachably attaching onto said firearm;

a first optic upwardly extended from said base to define a first sight axis parallel to said barrel axis of said firearm;

a second optic sidewardly extended from said first optic to define a second sight axis parallel to said barrel axis of said firearm and orientated at an offset angle with said first sight axis, wherein a distance between said first sight axis and said barrel axis equals to a distance between said second sight axis and said barrel axis; and an illumination control which comprises a first luminous element operatively provided in said first optic for illumining a first reticle thereof, a second luminous element operatively provided in said second optic for illumining a second reticle thereof, and a control panel provided at said base for independently controlling reticle illumination level and brightness level of each of said first and second luminous elements.

2. The sight module, as recited in claim 1, wherein said first optic comprises a tubular first lens housing upwardly extended from said base in an upright position with respect to said firearm, and a first lens assembly provided in said first lens housing that provides magnification zoom for aiming and identifying target at further distances.

3. The sight module, as recited in claim 2, wherein said second optic comprises a tubular second lens housing sidewardly and downwardly extended from said first lens housing at said offset angle with respect to said firearm, and a second lens assembly provided in said second lens housing for use in close-target situations.

4. The sight module, as recited in claim 3, wherein said first optic further comprises a first reticle adjustment formed at a surrounding wall of said first lens housing for selectively adjusting a reticle position of said first optic, wherein said second optic further comprises a second reticle adjustment formed at a surrounding wall of said second lens housing for selectively adjusting a reticle position of said second optic.

5. The sight module, as recited in claim 3, wherein said second lens housing is integrally extended from said first lens housing to form an integrated housing body.

6. The sight module, as recited in claim 4, wherein said first lens housing is integrally extended from said second lens housing to form an integrated housing body.

7. The sight module, as recited in claim 3, wherein said second lens housing is detachably coupled to said first lens housing.

8. The sight module, as recited in claim 1, wherein said illumination control further comprises a power source compartment provided at said base for receiving a power source therein in order to electrically link with said first and second luminous elements.

9. The sight module, as recited in claim 1, wherein said offset angle is 30°.

10. The sight module, as recited in claim 1, wherein said first and second optics are magnified scope and a non-magnified reflex dot optic respectively.

11. A sight module for a firearm having a barrel axis, comprising:

a base for detachably attaching onto said firearm;

a first optic upwardly extended from said base to define a first sight axis parallel to said barrel axis of said firearm, wherein said first optic comprises a tubular first lens housing upwardly extended from said base in an upright position with respect to said firearm:

a second optic sidewardly extended from said first optic to define a second sight axis parallel to said barrel axis of said firearm and orientated at an offset angle with said first sight axis, wherein said second optic comprises a tubular second lens housing integrally, sidewardly and downwardly extended from said first lens housing at said offset angle with respect to said firearm, and a second lens assembly provided in said second lens housing, wherein a distance between said first sight axis and said barrel axis equals to a distance between said second sight axis and said barrel axis, such that when said base is mounted onto said firearm, said first and second sight axes of said first and second optics are automatically aligned with the barrel axis of the firearm, so as to allow said first and second optics to be quickly switched when rotating the firearm with respect to a cheek weld position; and a power source compartment provided at said base for receiving a power source to electrically link with said first and second optics, such that said first and second optics share the same power source within said power source compartment.

* * * * *